US011346130B1

(12) United States Patent
Timothy

(10) Patent No.: US 11,346,130 B1
(45) Date of Patent: May 31, 2022

(54) DOUBLE LOCK DUAL ACTION GRAVITY LATCH

(71) Applicant: E. Erik Timothy, Apollo Beach, FL (US)

(72) Inventor: E. Erik Timothy, Apollo Beach, FL (US)

(73) Assignee: NATIONWIDE INDUSTRIES, INC, Tampa, FL (US)

( * ) Notice: Subject to any disclaimer, the term of this patent is extended or adjusted under 35 U.S.C. 154(b) by 750 days.

(21) Appl. No.: 16/350,561

(22) Filed: Dec. 3, 2018

(51) Int. Cl.

| | |
|---|---|
| ***E05B 65/00*** | (2006.01) |
| ***E05C 3/14*** | (2006.01) |
| ***E05C 3/12*** | (2006.01) |
| ***E05C 3/00*** | (2006.01) |
| ***E05B 15/00*** | (2006.01) |

(52) U.S. Cl.
CPC ..... *E05B 65/0007* (2013.01); *E05B 15/0093* (2013.01); *E05C 3/006* (2013.01); *E05C 3/124* (2013.01); *E05C 3/14* (2013.01)

(58) Field of Classification Search
CPC ..... E05B 65/0007; E05B 15/0093; E05B 65/5292; E05C 3/30; E05C 3/14; E05C 3/006; E05C 3/124; Y10T 292/1092; Y10T 70/5354; Y10T 70/5363; Y10T 292/1063; Y10T 70/7559; Y10S 292/13
See application file for complete search history.

(56) References Cited

U.S. PATENT DOCUMENTS 6,058,747 A * 5/2000 Doyle ..... E05B 13/105 70/137
9,803,396 B2 * 10/2017 Timothy ..... E05B 65/0007
(Continued)

*Primary Examiner* — Mark A Williams
(74) *Attorney, Agent, or Firm* — Arthur W. Fisher, III

(57) ABSTRACT

A double lock, dual action gravity latch device to secure a gate in a closed position comprising a latch assembly including a pivotal latch member movable between a latched and unlatched position, a keeper assembly including a striker pin to maintain the gate in the closed position when the pivotal latch member in the latched position, a latch lock assembly including a lock assembly with a first lock and a second lock each independently movable between a locked position and an unlocked position disposed on opposite sides of the gate to selectively move a lock subassembly from a locked position to an unlocked position when either the first lock or second lock is moved from the locked position to the unlocked position, and move the lock subassembly from the unlocked position to the locked position when the unlocked lock is moved from the unlocked position to the locked position and a first latch actuator and a second latch actuator each movable between a first position and a second position disposed on opposite sides of the gate to selectively move the pivotal latch member when either the first lock or the second lock is moved from the locked position to the unlocked position moving the lock subassembly from the locked position to the unlocked position such that when either the first actuator assembly or the second actuator assembly is moved from the first position to the second position the pivotal latch member is moved from the latched position to the unlatched position to allow the gate to be opened.

14 Claims, 12 Drawing Sheets

(56) References Cited

U.S. PATENT DOCUMENTS

| | | | | |
|---|---|---|---|---|
| 2006/0101876 | A1* | 5/2006 | Timothy | E05C 3/30 70/101 |
| 2007/0175249 | A1* | 8/2007 | Karcz | E05B 65/0007 70/101 |
| 2010/0045055 | A1* | 2/2010 | Taglianetti | E05B 1/0015 292/341.15 |
| 2010/0123321 | A1* | 5/2010 | Timothy | E05B 1/0038 292/69 |
| 2015/0191938 | A1* | 7/2015 | Karcz | E05C 3/24 70/101 |
| 2017/0037658 | A1* | 2/2017 | Karcz | E05B 65/0007 |

* cited by examiner

DOUBLE LOCK DUAL ACTION GRAVITY LATCH

BACKGROUND OF THE INVENTION

Field of the Invention

A double lock, dual action gravity latch device for use with a gate operable from either side of the gate to release a pivotal gravity latch permitting the gate to be opened.

Description of the Prior Art

Numerous gate latches have been designed to block or secure openings in fences of other inclosing barriers. Such designs include both gravity operated latches and magnetic latch devices.

U.S. Pat. No. 9,803,396 relates to dual action gravity latch device to secure a gate in a closed position comprising a latch assembly including a pivotal latch member movable between a latched and unlatched position, a keeper assembly including a striker pin to maintain the pivotal latch member in the latched position. A first and second actuator assembly each movable between a first configuration and a second configuration and disposed on opposite sides of the gate to selectively engage the pivotal latch member such that when the second actuator assembly is in the first configuration and the first actuator assembly in the second configuration the pivotal latch member is in the unlatched position to allow the gate to be opened and when the first actuator assembly is in the first configuration and the second actuator assembly is in the second configuration the pivotal latch member is in unlatched position to allow the gate to be opened.

US 2010/0244463 describes a magnetic latch system including a latch assembly and a keeper assembly. The keeper assembly includes a magnetically attractable keeper pin. The latch assembly includes two base assemblies, one on either side of a movable gate element. The base assembly adjacent the keeper assembly includes a magnet and an internal actuator which is arranged to engage the keeper pin to move it away from the permanent magnet when one of the latch handles is manually rotated. The system may also include a locking system in one or both handles to fix the internal actuator in a locked position so that it cannot engage the keeper pin.

U.S. Pat. No. 8,646,815 discloses a A gate latch system including a button assembly, a latch assembly, and a keeper assembly. The gate latch assembly can be opened from the side of the gate opposite the latch through the use of a spindle extending from a button assembly on one side of the gate to a latch assembly located on the opposite side of the gate and which includes a latch retention member. The latch assembly and button assembly are configured so that the spindle extends from the button assembly to the latch assembly through the gate opening such that there is no need to make a hole through the gate and/or covering to accommodate the spindle.

U.S. Pat. No. 7,201,030 describes a gate lock device with front and rear units mounted on opposite sides of a structure associated with the gate and against which the gate closes. A gravity latch, displaceably mounted in the housing of the front unit, is engageable with a keeper pin. The front and rear units are provided with key-operated locks which are operable to lock and unlock the gravity latch. The rear unit includes an axially displaceable actuator operable to unlock the gravity latch when the key-operated locks are unlocked.

U.S. Pat. No. 8,646,815 relates to a gate latch system including a button assembly, a latch assembly, and a keeper assembly. The gate latch assembly can be opened from the side of the gate opposite the latch through the use of a spindle extending from a button assembly on one side of the gate to a latch assembly located on the opposite side of the gate and which includes a latch retention member. The latch assembly and button assembly are configured so that the spindle extends from the button assembly to the latch assembly through the gate opening such that there is no need to make a hole through the gate and/or covering to accommodate the spindle.

U.S. Pat. No. 6,058,747 discloses a gravity latch comprising a housing for pivotally mounting a closure member and a cylinder lock located below the closure member. A remote actuator is mounted on the opposite side of the fence from the housing for moving the closure member. The remote actuator may include a lock so that the actuator cannot be operated.

U.S. Pat. No. 6,513,351 discloses a gravity latch which includes a housing for pivotally mounting a closure member and a cylinder lock situated below the closure member. U.S. Pat. No. 6,513,351 also discloses a remote actuator mounted oh the opposite side of the fence from which the housing is located. In addition, the remote actuator may include a cylinder lock which is connected through a gearing system to allow for locking the closure member from the remote location.

Examples of gravity operated or similar latch devices or assemblies are found in U.S. Pat. Nos. 2,767,007; 3,040,555; 3,601,799; 3,705,505; 4,073,520; 4,083,591; 2,284,370; US 2007/0175250 and US 2010/0148523.

Additional examples of magnetic latch devices can be found in U.S. Pat. Nos. 8,376,421; 5,362,116; 5,664,769; 7,044,511; 7,100,405; 5,114,195; 5,490,698; 5,823,026; 6,155,616; 6,666,435 and 7,390,035.

SUMMARY OF THE INVENTION

The present invention relates to a dual action gravity latch device comprising a latch assembly including a pivotal latch member mounted to a fence and a keeper or striker assembly including a striker pin attached to a gate disposed to selectively engage the pivot latch member.

The dual action gravity latch device further includes a first actuator assembly and a second actuator assembly each movable between a first configuration and a second configuration to engage and move the pivotal latch member from a first position to a second position to allow the gate to be opened.

The latch assembly comprises a latch housing having a keeper receiver opening to receive a portion of the keeper assembly and striker pin. The pivotal latch member comprises a hook-like member, a first or upper latch extension formed on the upper inner portion thereof and a second latch or lower latch extension formed on the lower inner portion thereof to selectively engage the first actuator assembly and the second actuator assembly respectively.

The pivotal latch member is pivotally mounted within the latch housing normally disposed in the latched position due to gravity. A spring or bias may be used as an additional force to normally maintain the pivotal latch member in the latched position.

The first actuator assembly comprises a first actuator subassembly rotatably between a first position and a second position disposed in the upper portion of the latch housing and a second actuator subassembly movable vertically between a first or upper position and a second or lower position disposed between the first actuator subassembly and the first or upper latch extension or element such that the first actuator subassembly engages the upper portion of the second actuator subassembly when the first actuator subassembly is rotated from the first position to the second position moving the second actuator subassembly vertically downward from the upper or first position to the lower or second position to engage the first or upper latch extension and rotate the hook-like member upwardly clearing or unlatching the striker pin from the striker pin recess allowing the gate to be opened. The bias will return the hook-like member to the latched position when the first actuator subassembly is rotated from the second position to the first position.

The second actuator assembly comprises a first actuator subassembly movable horizontally between a first position and a second position and a second actuator subassembly movable between a first position and a second disposed between the first actuator subassembly and the second or lower latch extension such that the second actuator subassembly engages the second or lower latch extension when the first actuator subassembly is moved horizontally from the first position to the second position to rotate the hook-like member upwardly clearing or unlatching the striker pin from the striker pin recess allowing the gate to be opened. The bias will return the hook-like member to the latched position when the first actuator subassembly is released and the bias returns from the second position to the first position as described hereinafter.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
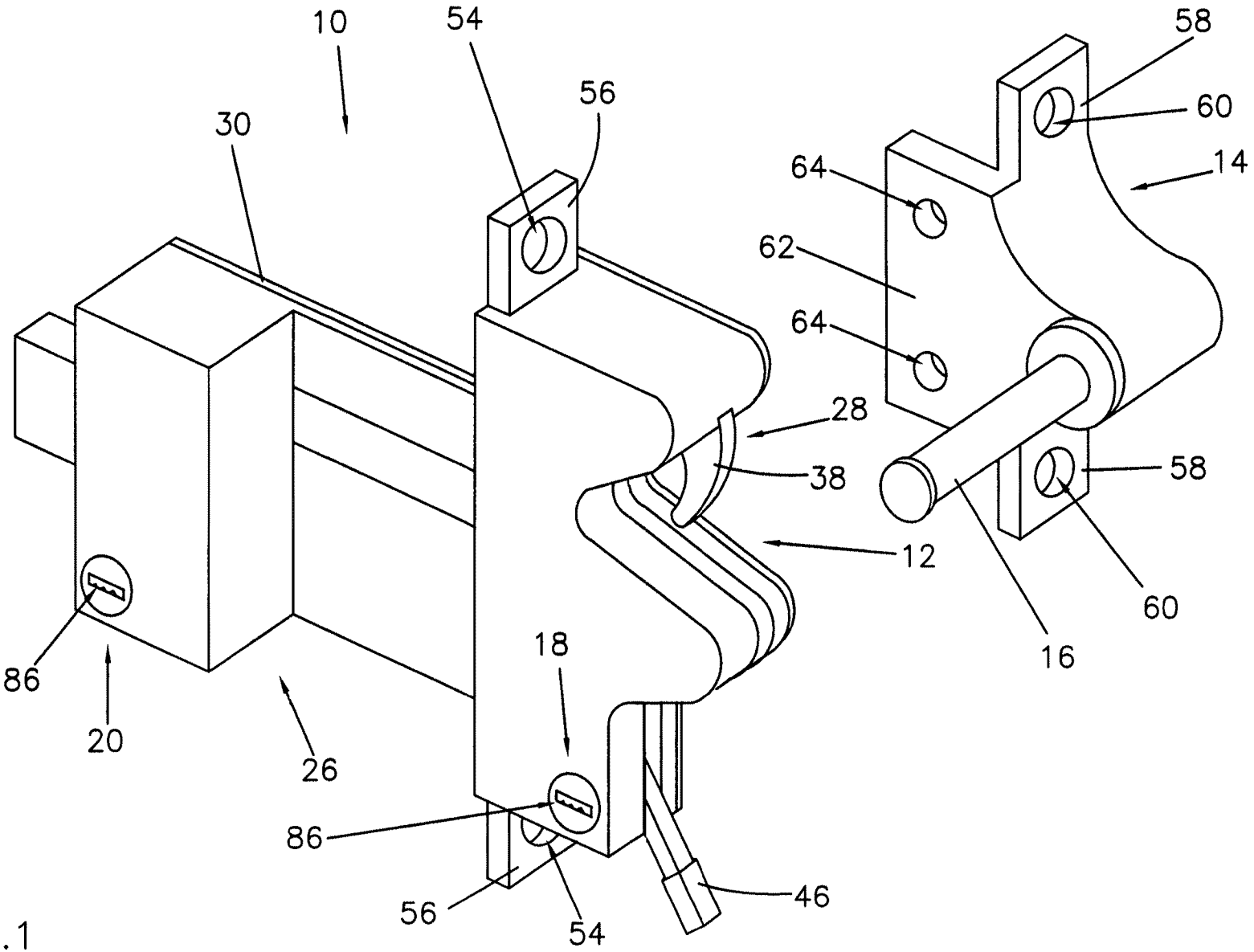
FIG. 1 is a perspective view of the double lock, dual action gravity device of the present invention.

As shown in FIG. 1, the present invention relates to a double lock, dual action gravity latch device comprising a latch assembly generally indicated as 10 including a pivotal latch member generally indicated as 12 mounted to a fence or door jam (not shown) and a keeper assembly generally indicated as 14 including a striker pin 16 attached to a gate or door (not shown) to selectively engage the pivotal latch member 12 to selectively maintain the gate or door (not shown) in the closed position.

Figure 2:
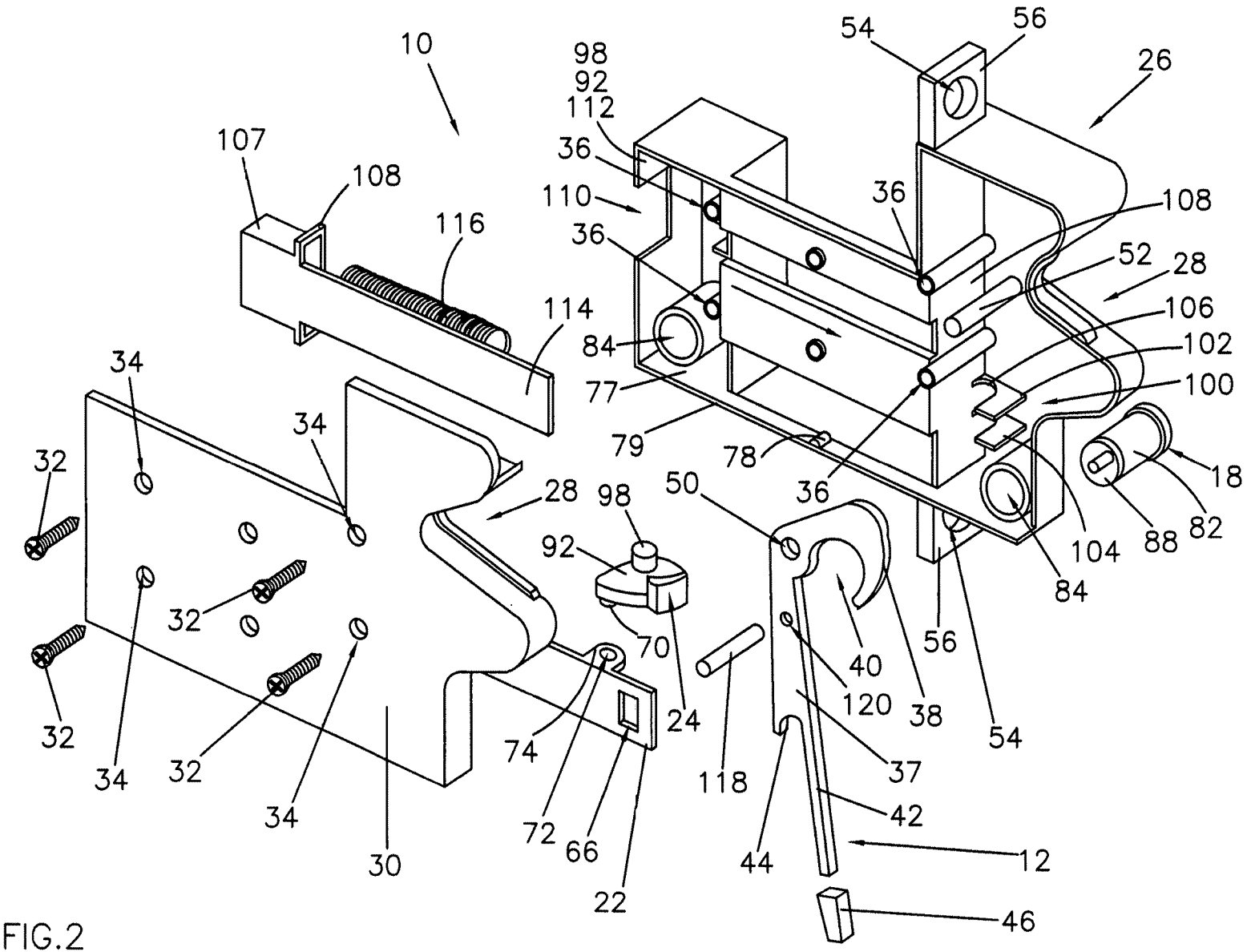
FIG. 2 is an exploded perspective view of the latch assembly of the double lock, dual action gravity latch device of the present invention.

As best shown in FIGS. 1 and 2, the latch assembly 10 comprises a latch lock assembly including a lock assembly with a first or proximal lock generally indicated as 18 and a second or distal lock generally indicated as 20 each independently movable between a locked position and an unlocked position disposed on the proximal side and distal side of the gate (not shown) respectively and a lock subassembly including a lock bar or member generally indicated as 22 and a lock cam or latch stop generally indicated as 24 selectively movable between a locked position and an unlocked position to selectively block movement of the pivotal latch member 12 from the latched position to the unlatched position when the lock subassembly is in the locked position.

As shown in FIGS. 1 and 2, the latch assembly 10 further comprises a latch housing generally indicated as 26 housing both the first or proximal lock 18 and the second or distal lock 20 in a single enclosure includes a keeper receiver opening 28 to receive the striker pin 16 of the keeper assembly 14 when the gate (not shown) is closed and a side plate generally indicated a 30 secured to the latch housing 26 by a plurality of fasteners each indicated as 32 extending through corresponding apertures 34 formed in the side plate 30 and into corresponding apertures or recesses 36 formed in the latch housing 26.

Figure 16:
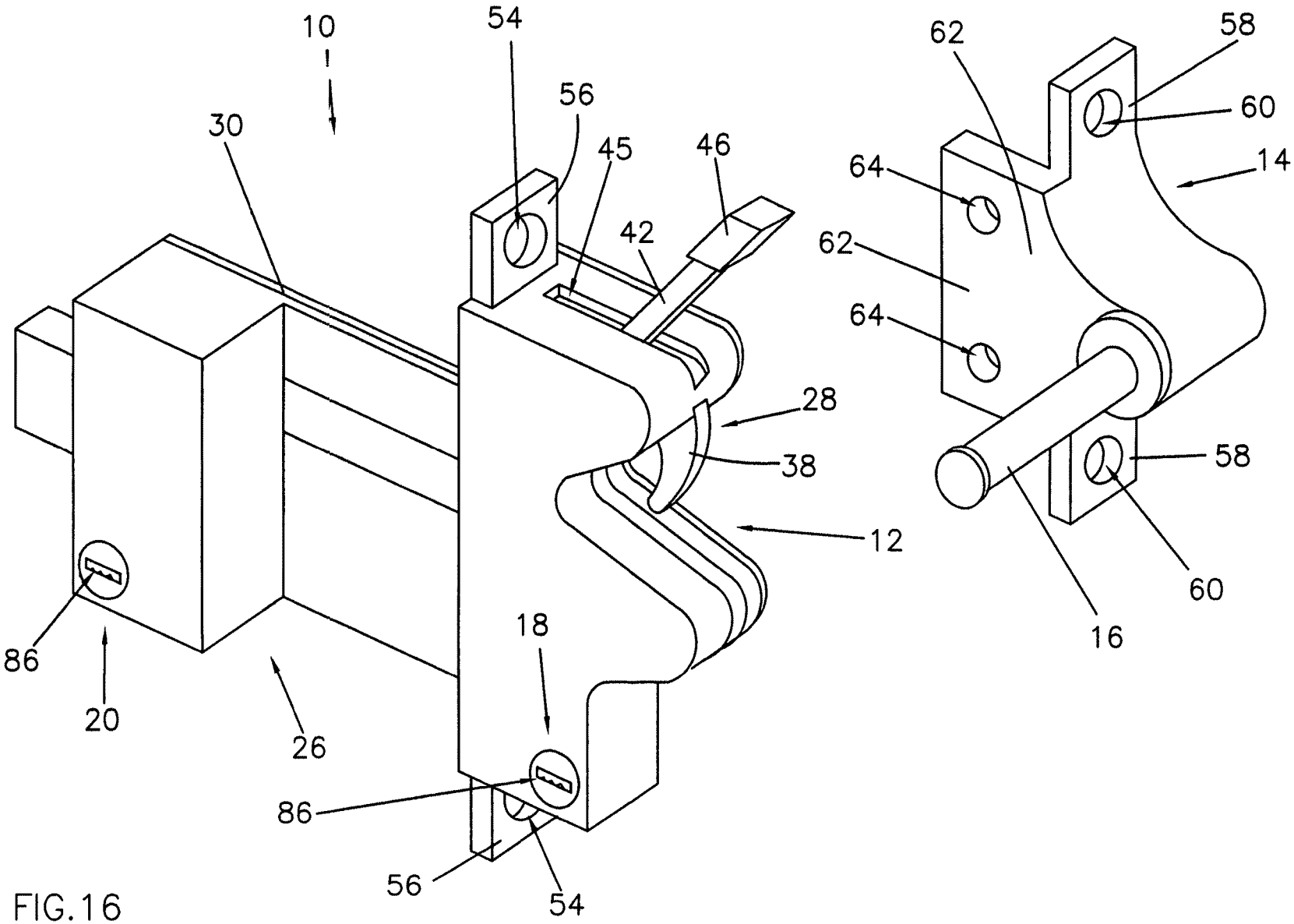
FIG. 16 is a perspective view of an alternate embodiment of the first latch member and knob of the double lock, dual action gravity latch device of the present invention.
Figure 17:
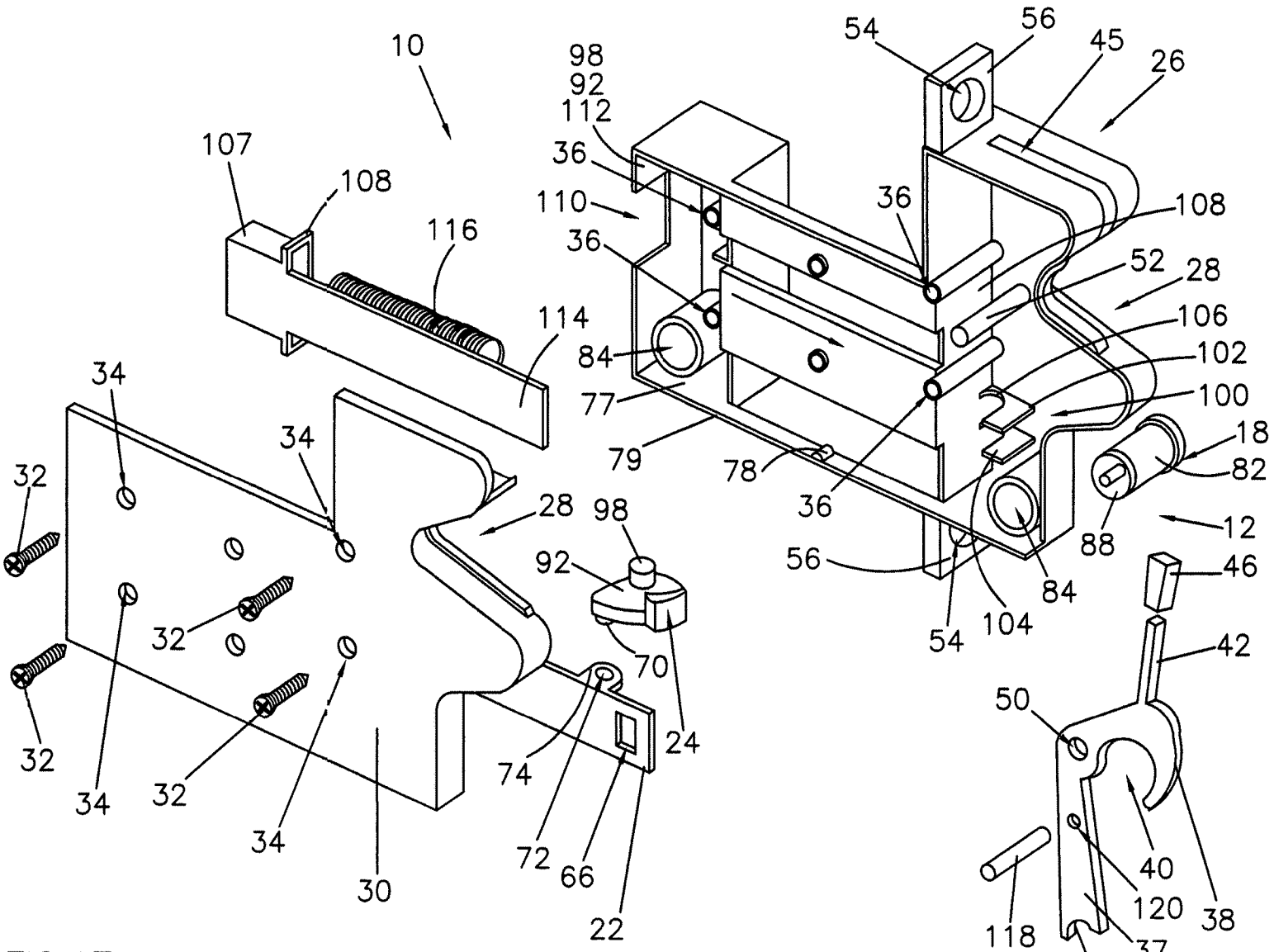
FIG. 17 is an exploded perspective view of the alternate embodiment of the first latch member and knob of the double lock, dual action gravity latch device of the present invention.

The pivotal latch member 12 comprises a body or substantially flat member 37 having an upper hook member 38 including a striker pin recess 40 on the upper portion thereof disposed within the keeper receiver opening 28, a first latch member 42 extending downward from the lower proximal portion of the body or substantially flat member 37 and a second latch member 44 formed on the lower distal portion of the body or substantially flat member 37. A latch knob 46 may be formed on the lower portion of the first latch member 42. The pivotal latch member 12 is pivotally mounted within the latch housing 26 on a latch mounting pin 48 extending through a pivot aperture 50 formed on the upper portion of the pivotal latch member 12 and into a mounting pin recess 52. The pivotal latch member 12 is normally disposed in the latched position due to gravity. Alternately, the first latch member 42 and knob 46 may be formed on the upper portion of the pivotal latch member 12 as shown in FIGS. 16 and 17 where the first latch member 42 extends upwardly through formed in the latch housing 28.

The latch assembly 10 is affixed to the fence (not shown) with fasteners (not shown) passing through holes 54 formed through an upper and lower mounting flange each indicated as 56.

As shown in FIG. 1, the keeper assembly 14 is affixed to the gate (not shown) by an upper and lower front attachment flange each indicated as 58 including holes 60 and side attachment flanges 62 including holes 64 receive fasteners such as screws (not shown).

The latch lock assembly comprises the lock assembly including the first or proximal lock 18 and the second or distal lock 20 together with the lock subassembly including the lock bar or member 22 having a proximal bar actuator aperture or recess 66 and a distal bar actuator aperture or recess 68 formed on proximal end portion and distal end portion of the lock bar or member 22 respectively with the lock cam or latch stop 24 pivotally mounted on the lock bar or member 22 by a pivot pin 70 extending through a pivot opening or recess 72 formed in or through a cam mounting flange 74. The pivot opening or recess 72 and the cam mounting flange 74 may be formed on each end portion of the lock bar or member 62 to allow for a left hand or right hand gate mount.

Figure 18:
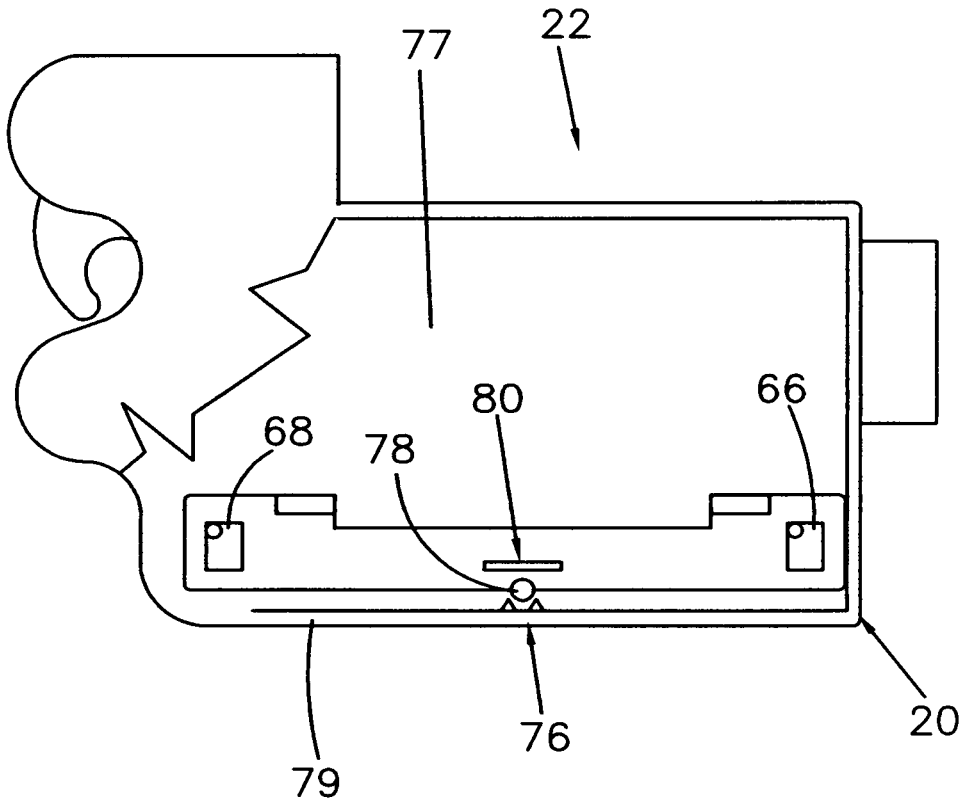
FIG. 18 is a side view of an alternate embodiment of the stabilizer of the double lock, dual action gravity latch device of the present invention.

The lock bar or member 22 further includes a stabilizer such as a sawtooth recess or cut out portion 76 formed in the lower edge of the lock bar or member 22 to engage a ridge or protrusion 78 formed on the inner surface 77 of the lower or bottom wall 79 of the latch housing 26 to assist in maintaining the alignment of the lock bar or member 62 relative to the first or proximal lock 18 and the second or distal lock 20 during linear movement of the lock bar or member 22 between the locked and unlocked position. In addition, a slot or groove 80 may be formed in the lock bar or member 22 above the sawtooth recess or cut out portion 76 to allow for resilient flexing of the engagement between the sawtooth recess or cut out portion 76 and the ridge or protrusion 78. Alternately, as shown in FIG. 18 the sawtooth recess or cut out portion 76 may be formed on the upper surface 77 of the lower or bottom wall 79 of the latch housing 26; while, the ridge or protrusion 78 is formed on the lower portion of the lock bar or member 22.

The first or proximal lock 18 and the second or distal lock 20 each comprises a three (3) position cylinder or lock 82 disposed within a corresponding sleeve 84 and having a keyway or key slot 86 formed on the outer portion thereof to receive a key (not shown) therein to rotate the cylinder lock 80 between the three (3) positions—unlocked position, locked position and neutral position. A bar actuator pin or member 88 extends outwardly from the inner portion of each cylinder or lock 82 to engage the inner periphery or perimeter 90 of the corresponding bar actuator aperture or recess 66 to move or slide the lock bar or member 22 linearly rotating the lock cam or latch stop 24 between the locked and unlocked position as the key (not shown) is rotated in the cylinder or lock 82.

As shown in FIGS. 2 through 9, the lock cam or latch stop 24 comprises the cam mounting pin 70 extending downward from the lower surface of a substantially flat cam body or plate 92, an arcuate cam member 94 including an angled or inclined surface 96 extending upward from the upper surface of the substantially flat cam body or plate 92 and a cam mounting pin 98 opposite the arcuate cam member 94.

As shown in FIG. 2, when the double lock, dual action gravity latch is fully assembled the substantially flat cam body or plate 92 is disposed or located in a slot 100 formed between an upper cam retainer plate 102 and a lower cam retainer plate 104 each includes a concave recess 106 to receive a portion of the cam mounting pin 98 extending outward from an inner wall 108.

As shown in FIG. 2, the first latch actuator comprises the latch knob 46 and the first latch member 42 of the pivotal latch member 12 to move the pivoted latch member 12 from the latched position to the unlatched position when the latch assembly 10 is in the unlocked position formed in the rear or back wall 112 of the latch housing 26.

As shown in FIG. 2, the second actuator assembly comprises a plunger 107 partially retained within the latch housing 26 by an outer retainer flange 108 disposed inside the periphery of an outer plunger opening 110, an elongated actuator bar 114 extending inwardly from the outer retainer flange 102 and the plunger 107 and a bias or spring 116 partially disposed within the latch housing 26 to normally maintain the second actuator assembly in the first position. An actuator pin 118 extends through a mounting hole 120 formed on the upper portion of the pivot latch member 12 to engage the inner portion of the elongated actuator bar 114 when the plunger 107 is moved inwardly against the force of the bias or spring 116 when the latch assembly is in the unlocked position to pivot the pivot latch member 12 to the open position allowing the gate to be opened. When the plunger 107 released, the bias or spring 116 returns the second actuator to the first or extended position allowing the pivoted latch member to return to the first position.

Figure 14:
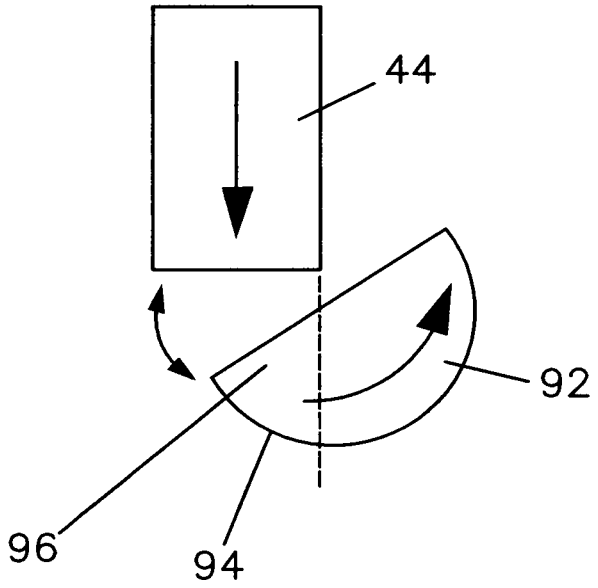
FIG. 14 is a top schematic view of the pivotal latch member and cam member or latch stop of the double lock, dual action gravity latch device of the present invention with the cam member or latch stop in the locked position.

As shown in FIGS. 5, 6, 12 and 14, when the lock assembly and lock subassembly of the latch lock assembly are in the locked position movement of the pivotal latch member 12 from the latched position to the unlatched position is blocked as the second latch member 44 formed on the lower distal portion of the body or substantially flat member 37 engages or strikes the angled or inclined surface 96 of the arcuate cam member 94 of the lock cam or latch stop 24 at an inner obtuse angle. As shown in FIG. 14, the second latch member 44 engages the angled or inclined surface 96 pushing or forcing the lock cam or latch stop 24 away from the unlocked position.

Figure 3:
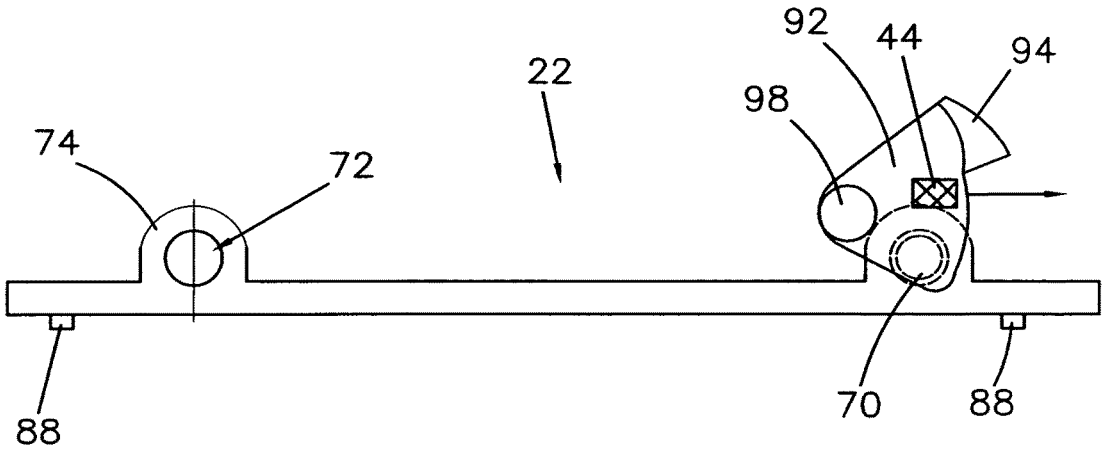
FIG. 3 is a top view of the lock subassembly of the double lock, dual action gravity latch device of the present invention in the unlocked position.
Figure 4:
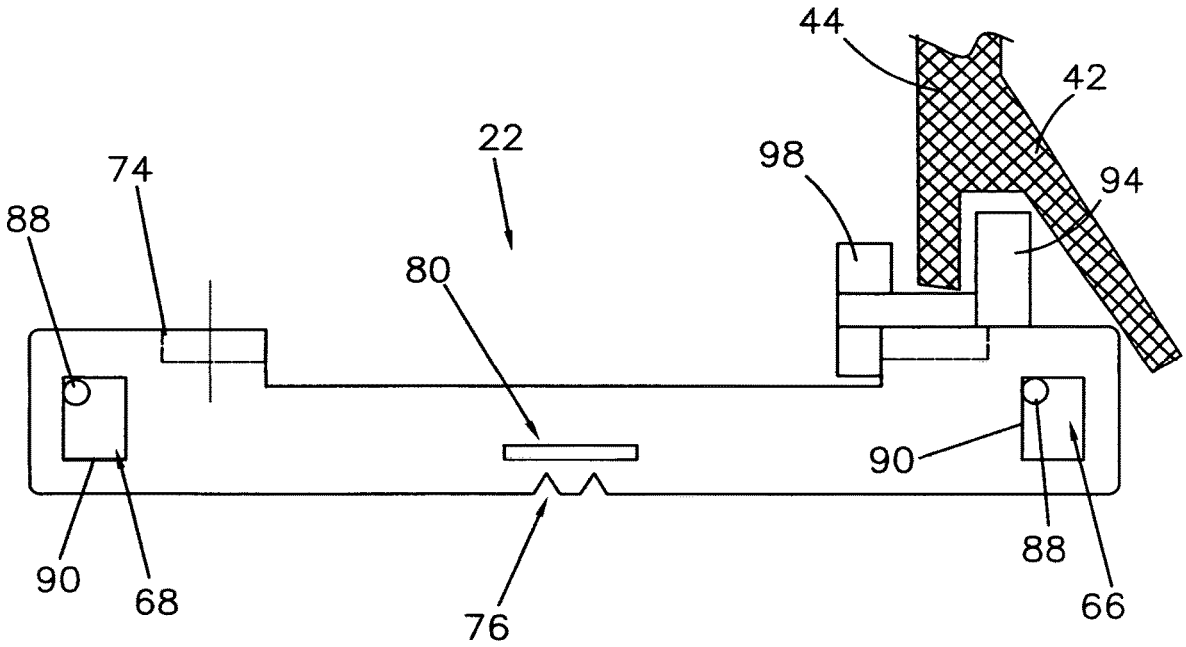
FIG. 4 is a side view of the lock subassembly of the double lock, dual action gravity latch device of the present invention in the unlocked position.
Figure 10:
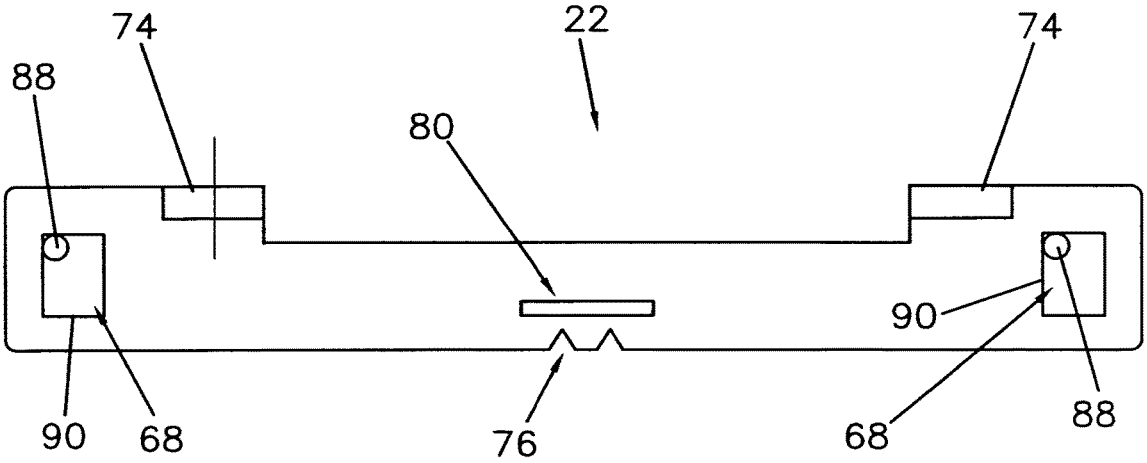
FIG. 10 is a side view of the lock bar or member of the double lock, dual action gravity latch device of the present invention in the unlocked position.
Figure 15:
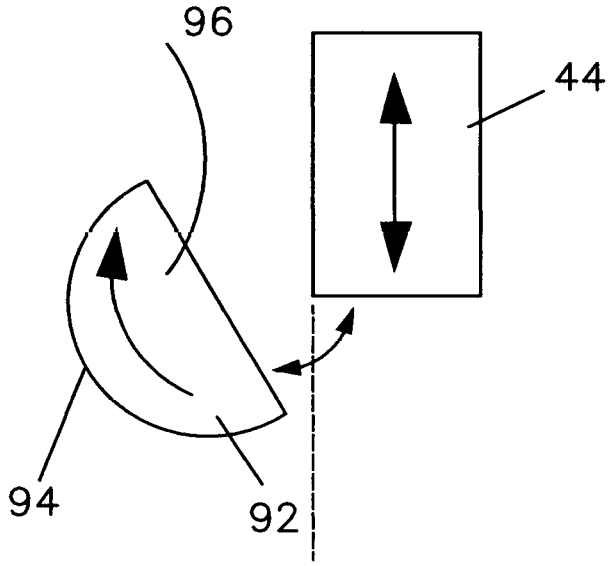
FIG. 15 is a top schematic view of the pivotal latch member and cam member or latch stop of the double lock, dual action gravity latch device of the present invention with the cam member or latch stop in the unlocked position.

To move the lock assembly and lock subassembly of the latch lock assembly from the locked position (FIG. 12) to the unlocked position (FIG. 10), the cylinder 82 of either of the locks 18 or 20 is rotated, first or proximal lock 18 shown, from the locked position to unlocked position moving the corresponding pin 88 against the inner periphery or perimeter 90 of the corresponding bar actuator aperture or recess 66 (FIG. 13) moving or sliding the lock bar or member 22 linearly to rotate the lock cam or latch stop 24 to the unlocked position as shown in FIGS. 3, 4 and 15 allowing the pivot latch member 12 to rotate passed the lock cam or latch stop 24 permitting the gate or door (not shown) to be opened. To remove the key (not shown) when the lock assembly and lock subassembly are in the intermediate unlocked position or configuration (FIG. 13), the key (not shown) is rotated in the opposite direction rotating the cylinder 82 and pin 88 to the position as shown in FIG. 10.

Figure 5:
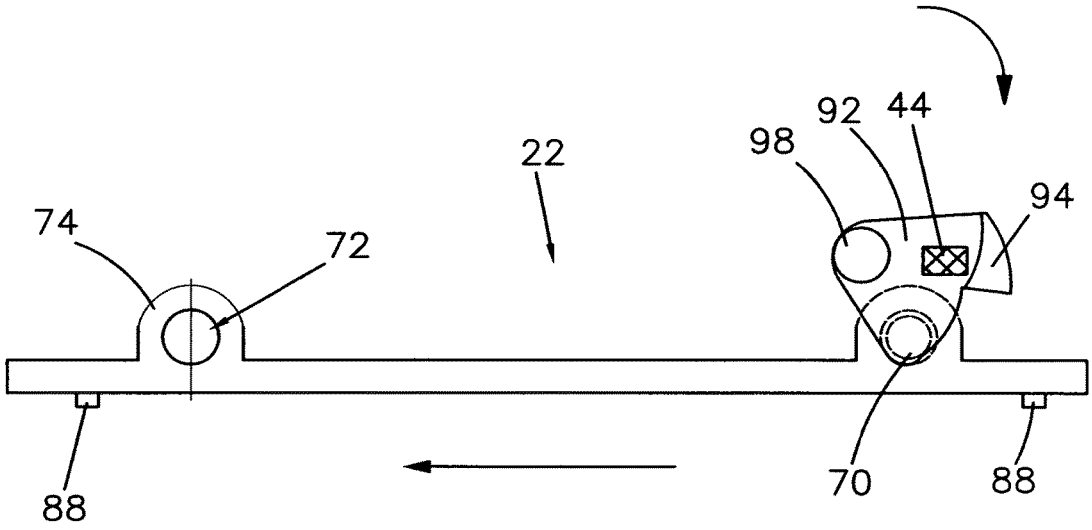
FIG. 5 is a top view of the lock subassembly of the double lock, dual action gravity latch device of the present invention in the locked position.
Figure 6:
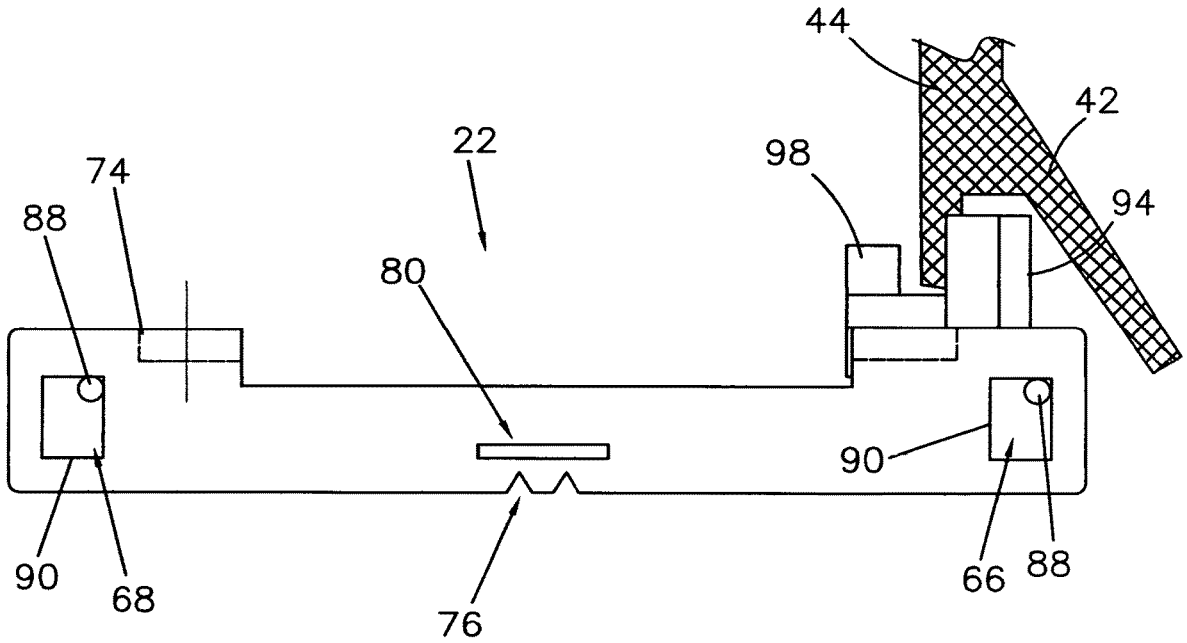
FIG. 6 is a side view of the lock subassembly of the double lock, dual action gravity latch device of the present invention in the locked position.
Figure 7:
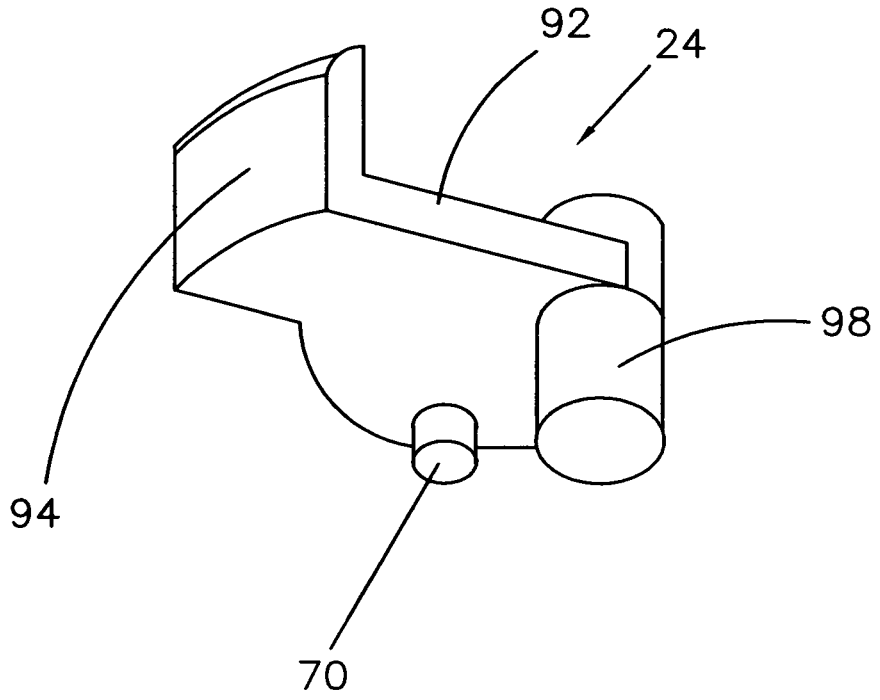
FIG. 7 is a bottom perspective view of the lock cam or latch stop of the double lock, dual action gravity latch device of the present invention.
Figure 8:
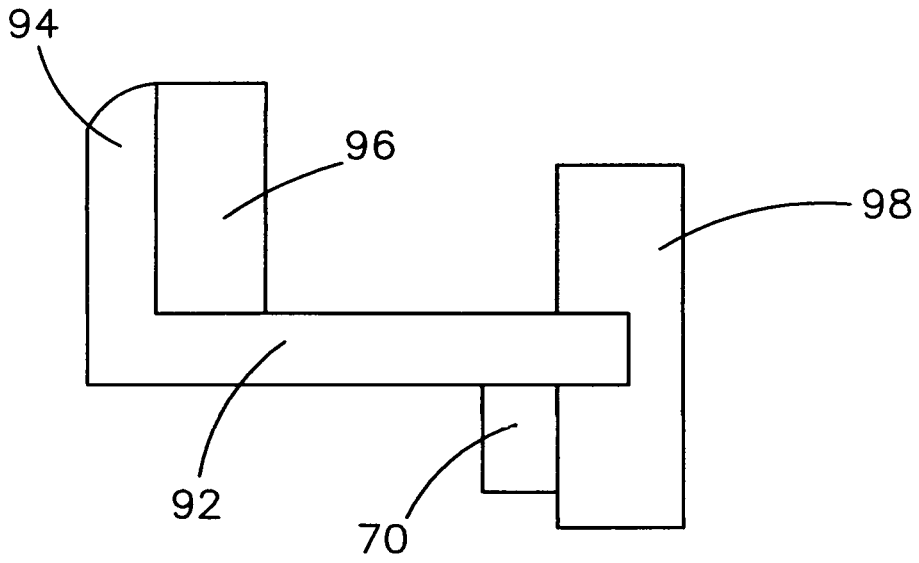
FIG. 8 is a side view of the lock cam or latch stop of the double lock, dual action gravity latch device of the present invention.
Figure 9:
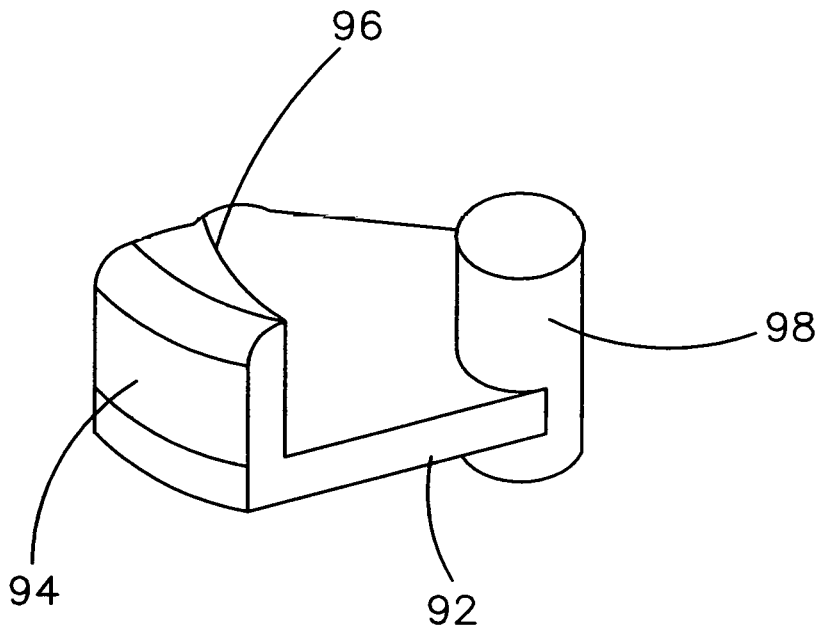
FIG. 9 is a top perspective view of the lock cam or latch stop of double lock, dual action gravity latch device of the present invention.
Figure 11:
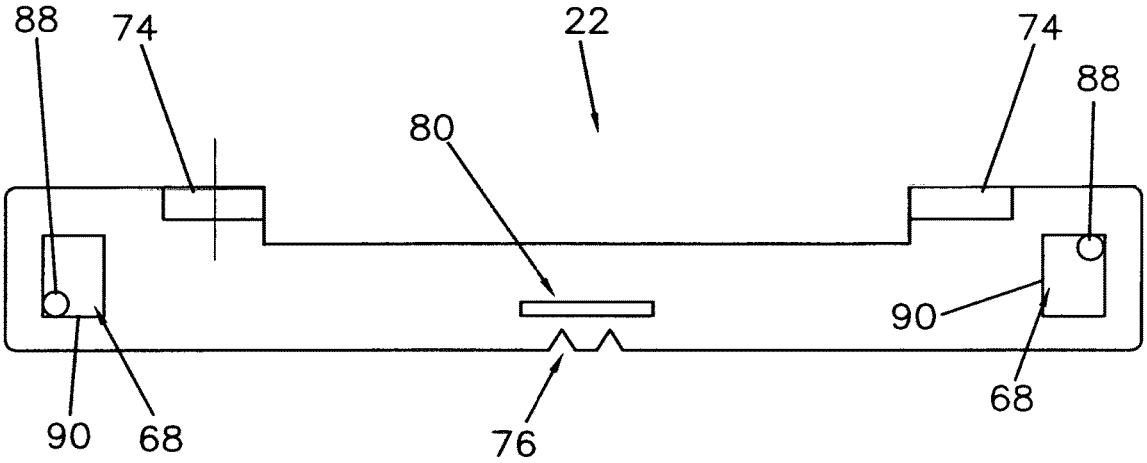
FIG. 11 is a side view of the lock bar or member of the double lock, dual action gravity latch device of the present invention in the intermediate locked position.
Figure 12:
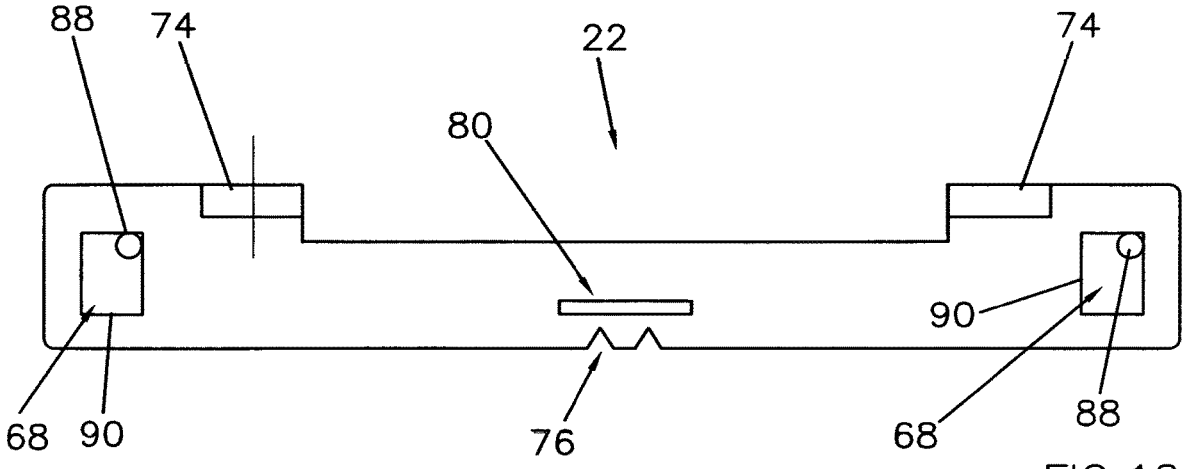
FIG. 12 is a side view of the lock bar or member of the double lock, dual action gravity latch device of the present invention in the locked position.
Figure 13:
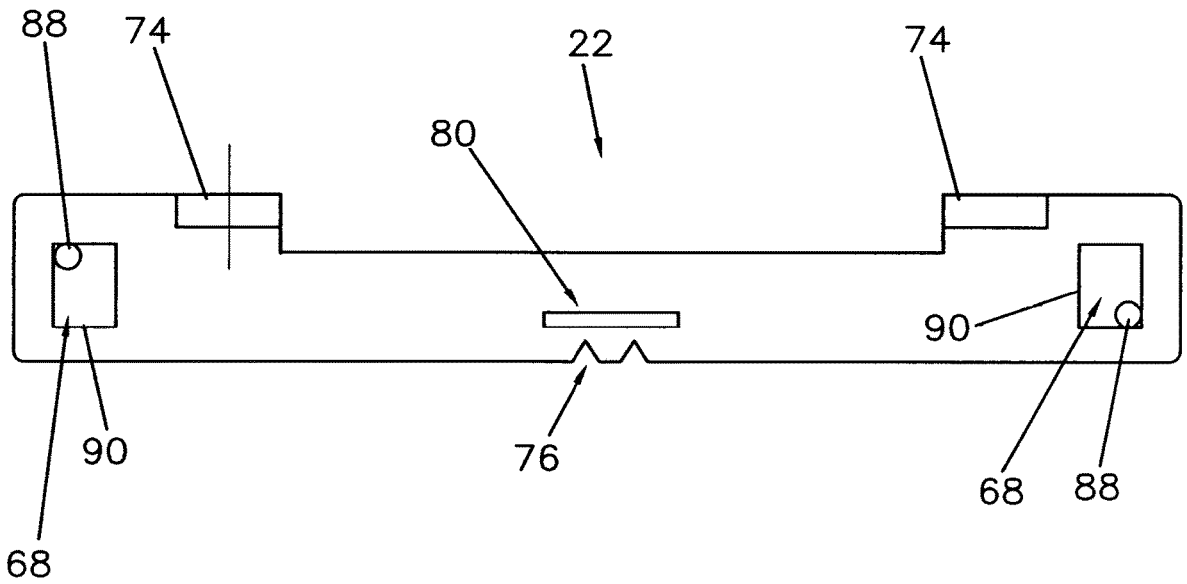
FIG. 13 is a side view of the lock bar or member of the double lock, dual action gravity latch device of the present invention in the intermediate unlocked position.

In a similar manner, to move the lock assembly and lock subassembly of the latch lock assembly from the unlocked position (FIG. 10) to the locked position (FIG. 12), the cylinder 82 of either of the locks 18 or 20 is rotated, second or distal lock 20 shown, from the unlocked position to the locked position moving the corresponding pin 88 against the inner periphery or perimeter 90 of the corresponding bar actuator aperture or recess 66 (FIG. 11) moving or sliding the lock bar or member 22 linearly to rotate the cam or latch stop 24 to the locked position as shown in FIGS. 5, 6 and 14 blocking the pivot latch member 12 from rotating past the lock cam or latch stop to prevent the gate or door (not shown) from opening. To remove the key (not shown) when the lock assembly and lock subassembly are in the intermediate locked position or configuration (FIG. 11), the key (not shown) is rotated in the opposite direction rotating the cylinder 82 and pin 88 to the position as shown in FIG. 12.

The key (not shown) may only be removed from the lock 18 or 20 once the key (not shown) is rotated back to the neutral position.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A dual action latch device to secure a gate in a closed position to block the opening or portal in a fence wherein the gate includes a proximal side and a distal side, said dual action latch device comprising a latch assembly including a first lock and a second lock disposed on the proximal side and distal side of the gate respectively to selectively secure the gate in the closed position and a pivotal latch member movable between a latched position and an unlatched position, a keeper assembly including a striker pin to engage said pivotal latch member when said pivotal latch member is in said latched position to maintain the gate in the closed position when said pivotal latch member is in said latched position, and to disengage said pivotal latch member when said pivotal latch member is in said unlatched position to allow the gate to be opened, a first actuator assembly and a second actuator assembly each movable between a first position or configuration and a second position or configuration disposed on the proximal side and distal side of the gate respectively to selectively engage said pivotal latch member when either said first lock or said second lock is in an unlocked position such that when said first actuator assembly is moved from said first position or configuration to said second position or configuration said first actuator assembly moves said pivotal latch member from said latched position to said unlatched said latch assembly further comprising a latch lock assembly including a lock assembly with a first or proximal lock and a second or distal lock, each said lock independently movable between a locked position and an unlocked position disposed on the proximal side and distal side of the gate respectively position to allow the gate to be opened or when said second actuator assembly is moved from said first position or configuration to said second position or configuration said second actuator assembly moves said pivotal latch member from said latched position to said unlatched position to allow the gate to be opened said latch assembly further comprising a latch lock assembly including a lock assembly with a first or proximal lock and a second or distal lock, each said lock independently is movable between a locked position and an unlocked position disposed on the proximal side and a distal side of the gate respectively and a lock subassembly including a lock bar or member having a proximal bar actuator aperture or recess and a distal bar actuator aperture or recess formed on a proximal end portion and a distal end portion of said lock bar or member respectively together with a lock cam or latch stop movable between a locked position and an unlocked position pivotally mounted on said lock bar or member disposed to engage said pivotal latch member when said lock cam or latch stop is in said locked position to prevent movement of said pivot latch member from said locked position.

2. The dual action latch device of claim 1 wherein said latch assembly further comprises a latch housing to retain a portion of said pivotal latch member and to said first or proximal lock and said second or distal lock in a single enclosure including a keeper receiver opening to receive said striker pin of said keeper assembly when the gate is closed.

3. The dual action latch device of claim 2 wherein said pivotal latch member comprises a body member having a hook member including a striker pin recess disposed within said keeper receiver opening, said body member having a first latch member and a second latch member formed thereon.

4. The dual action latch device of claim 1 wherein said lock bar or member further includes a stabilizer formed on said lock bar or member to engage an element formed on or said latch housing to assist in maintaining the alignment of said lock bar or member relative to said first or proximal lock and said second or distal lock during linear movement of said lock bar or member between the locked and unlocked position.

5. The dual action latch device of claim 4 wherein said lock bar or member further includes a slot or groove to allow resilient flexing of said lock bar or member during linear movement of said lock bar or member.

6. The dual action latch device of claim 4 wherein said stabilizer comprises a recess or cut out portion formed in a lower edge of said lock bar or member to engage a ridge or protrusion formed on a lower or bottom wall of said latch housing.

7. The dual action latch device of claim 4 wherein said stabilizer comprises a recess or cut out portion formed on a lower or bottom wall of said latch housing and a ridge or protrusion formed on a lower portion of said lock bar or member.

8. The dual action latch device of claim 1 wherein said first or proximal lock and said second or distal lock each comprises a cylinder or lock having a keyway or key slot to receive a key therein to rotate said corresponding cylinder or lock of said first or proximal lock or said second or distal lock between an unlocked position and locked position, said lock subassembly further comprising a bar actuator pin or member extending outwardly from each said cylinder or lock to engage an inner periphery or perimeter of a corresponding bar actuator aperture or recess formed on opposite end portions of said lock bar or member to move or slide said lock bar or member linearly rotating said lock cam or latch stop said between said locked and said unlocked position as a key is rotated in said corresponding cylinder or lock.

9. The dual action latch device of claim 8 wherein said lock cam or latch stop further includes an angled surface such that when said lock assembly and said lock subassembly of said latch lock assembly are in said locked position movement of said pivotal latch member from said latched position to said unlatched position is blocked as said second latch member engages said angled surface of said lock cam or latch stop.

10. The dual action latch device of claim 9 wherein said second latch member engages said inclined surface of said lock cam or latch stop exerting a force against rotation of said lock cam or latch stop to said unlocked position.

11. The dual action latch device of claim 8 when said lock assembly and lock subassembly of said latch lock assembly is moved from said locked position to said unlocked position, said cylinder of either of said locks is rotated from said locked position to unlocked position moving said corresponding pin against the inner periphery or perimeter of said corresponding bar actuator aperture or recess sliding said lock bar or member linearly to rotate said lock cam or latch stop to said unlocked position allowing said pivot latch to rotate passed said lock cam or latch stop permitting the gate to be opened.

12. The dual action latch device of claim 11 wherein rotation of the key in the opposite direction return cylinder and pin to said original position.

13. The dual action latch device of claim 8 when said lock assembly and lock subassembly of said latch lock assembly is moved from said unlocked position to said locked position by rotating said cylinder of either of said locks said corresponding pin is rotated against said inner periphery or perimeter of said corresponding bar actuator aperture or recess sliding said lock bar or member linearly to rotate said lock cam or latch stop to the locked position to engage said pivot latch member when said pivot latch member is pivoted from said latch position toward said unlatched position by either said first latch actuator or said second latch actuator preventing said pivot match member from pivoting to said unlatched position to prevent the gate from opening.

14. The dual action latch device of claim 13 wherein rotation of the key in the opposite direction returns said cylinder and pin to said original positions.

* * * * *